US005282748A

United States Patent [19]

Little

[11] Patent Number: 5,282,748

[45] Date of Patent: Feb. 1, 1994

[54] SWIMMING SIMULATOR

[76] Inventor: Oscar L. Little, 14 Scuppo Rd., Danbury, Conn. 06810

[21] Appl. No.: 954,039

[22] Filed: Sep. 30, 1992

[51] Int. Cl.[5] ..... A63B 69/10

[52] U.S. Cl. ..... 434/254; 482/56

[58] Field of Search ..... 434/254, 247; 482/55, 482/56

[56] References Cited

U.S. PATENT DOCUMENTS

| | | | |
|---|---|---|---|
| 2,013,520 | 9/1935 | McDermott | 482/56 |
| 2,109,775 | 3/1938 | Hudson . | |
| 3,791,646 | 2/1974 | Marchignoni . | |
| 3,810,614 | 5/1974 | Hessburg . | |
| 3,966,202 | 6/1976 | Cynamon . | |
| 4,422,634 | 12/1983 | Hopkins . | |
| 4,674,740 | 6/1987 | Iams et al. . | |
| 4,830,363 | 5/1989 | Kennedy . | |
| 4,844,450 | 7/1989 | Rodgers, Jr. . | |
| 4,872,668 | 10/1989 | McGillis et al. . | |
| 4,948,119 | 8/1990 | Robertson, Jr. . | |

FOREIGN PATENT DOCUMENTS

| | | | |
|---|---|---|---|
| 0719389 | 2/1939 | France | 482/56 |

*Primary Examiner*—Gene Mancene
*Assistant Examiner*—Jeffrey A. Smith
*Attorney, Agent, or Firm*—John H. Crozier

[57] ABSTRACT

In a preferred embodiment, a swimming simulator, including: a horizontal frame to support a user in a horizontal plane above a surface on which the simulator is disposed, with the user's shoulders near a front edge of the frame and the user's hips near a rear edge of the frame; supports to support the frame spaced above the surface; two generally horizontal bars extending outwardly from the sides of the frame, the proximal ends of the bars being rotatably attached to the frame such that the distal ends of the horizontal bars can move arcuately in generally horizontal planes; resistances disposed at selected points between the proximal and the distal ends of the horizontal bars to resist the arcuate movement; hand grips attached to the distal ends of the horizontal bars, the hand grips being graspable by the user to move the horizontal bars in the arcuate movement.

13 Claims, 2 Drawing Sheets

SWIMMING SIMULATOR

BACKGROUND OF THE INVENTION

1. Field of the Invention

The present invention relates to exercise and training devices generally and, more particularly, but not by way of limitation, to a novel swimming simulator for the teaching and training of swimmers.

2. Background Art

There have been a number of devices designed for the water-free simulation of the motions of swimming. Many of these devices employ systems of weights and pulleys and all are relatively complicated. Some are suitable only for semipermanent installation in gymnasiums or commercial operations.

A significant disadvantage of such known devices is that, in some cases, the arm motions for the three most common swimming strokes —crawl, back, and butterfly — cannot be simulated satisfactorily with one device. In other cases, resistance is not provided during both the pulling and return portions of a stroke. These disadvantages derive largely from the linkages in the purely mechanically joined motion devices limiting the range of motion and the springs and pulleys in the devices employing those not providing sufficient training resistance during the return portion of a stroke.

Accordingly, it is a principal object of the present invention to provide a swimming simulator that is simple in construction.

It is a further object of the invention to provide such a simulator that is easily disassembled for storage and transportation.

It is an additional object of the invention to provide such a simulator that is readily adjusted for varying degrees of resistance and/or for differing sizes of users.

It is another object of the invention is to provide such a simulator that can be employed to simulate arm motions for the crawl, back, and butterfly strokes.

A further object of the invention is to provide a simulator that provides resistance during both the pulling and return portions of an arm stroke.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a swimming simulator, comprising: a horizontal frame to support a user in a horizontal plane above a surface on which the simulator is disposed, with said user's shoulders near a front edge of said frame and said user's hips near a rear edge of said frame; support means to support said frame spaced above said surface; two generally horizontal bars extending outwardly from the sides of said frame, the proximal ends of said bars being rotatably attached to said frame such that the distal ends of said horizontal bars can move arcuately in generally horizontal planes; resistance means disposed at selected points between said proximal and said distal ends of said horizontal bars to resist said arcuate movement; hand grips attached to said distal ends of said horizontal bars, said hand grips being graspable by said user to move said horizontal bars in said arcuate movement.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
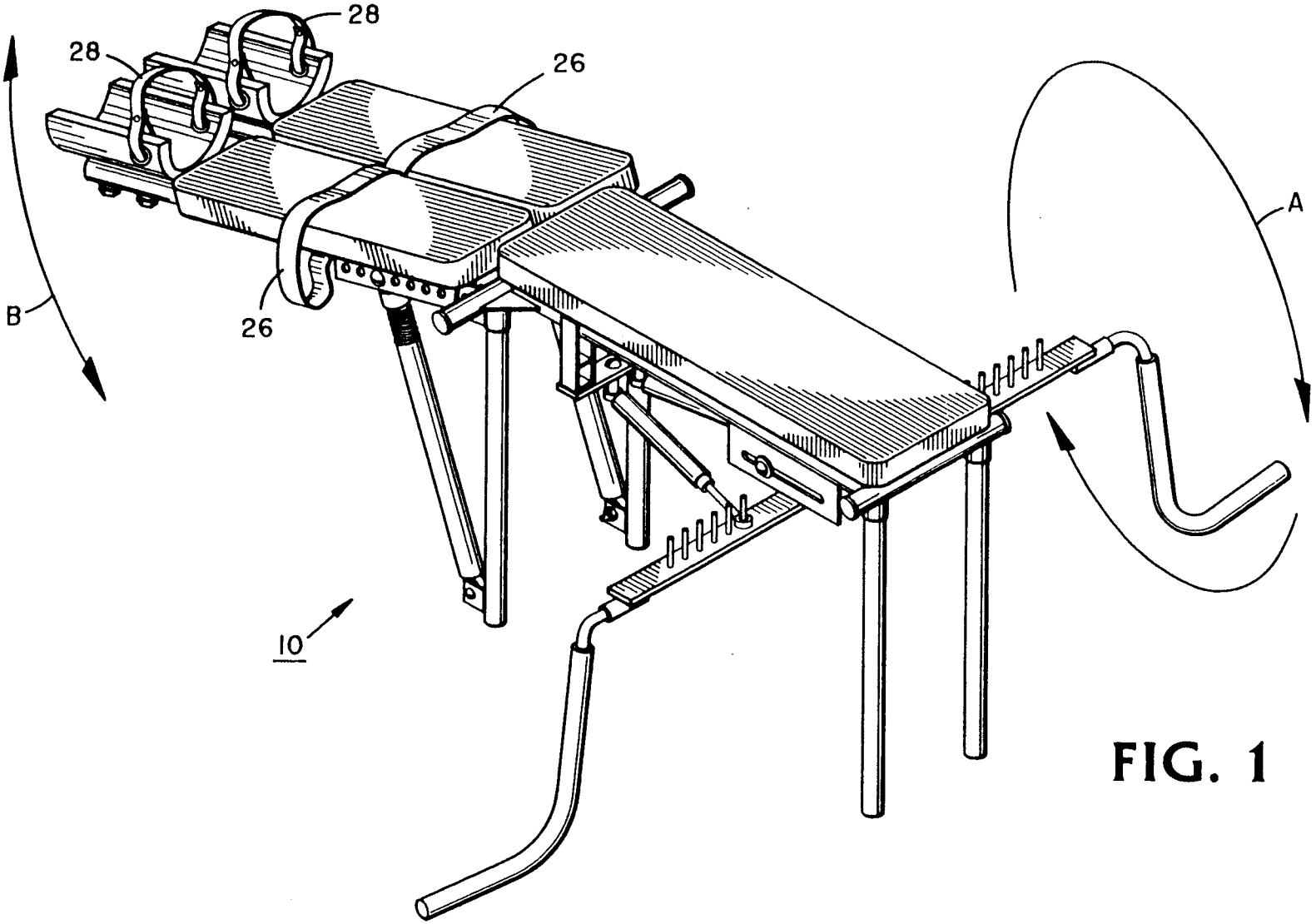
FIG. 1 is a perspective view of a swimming simulator constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
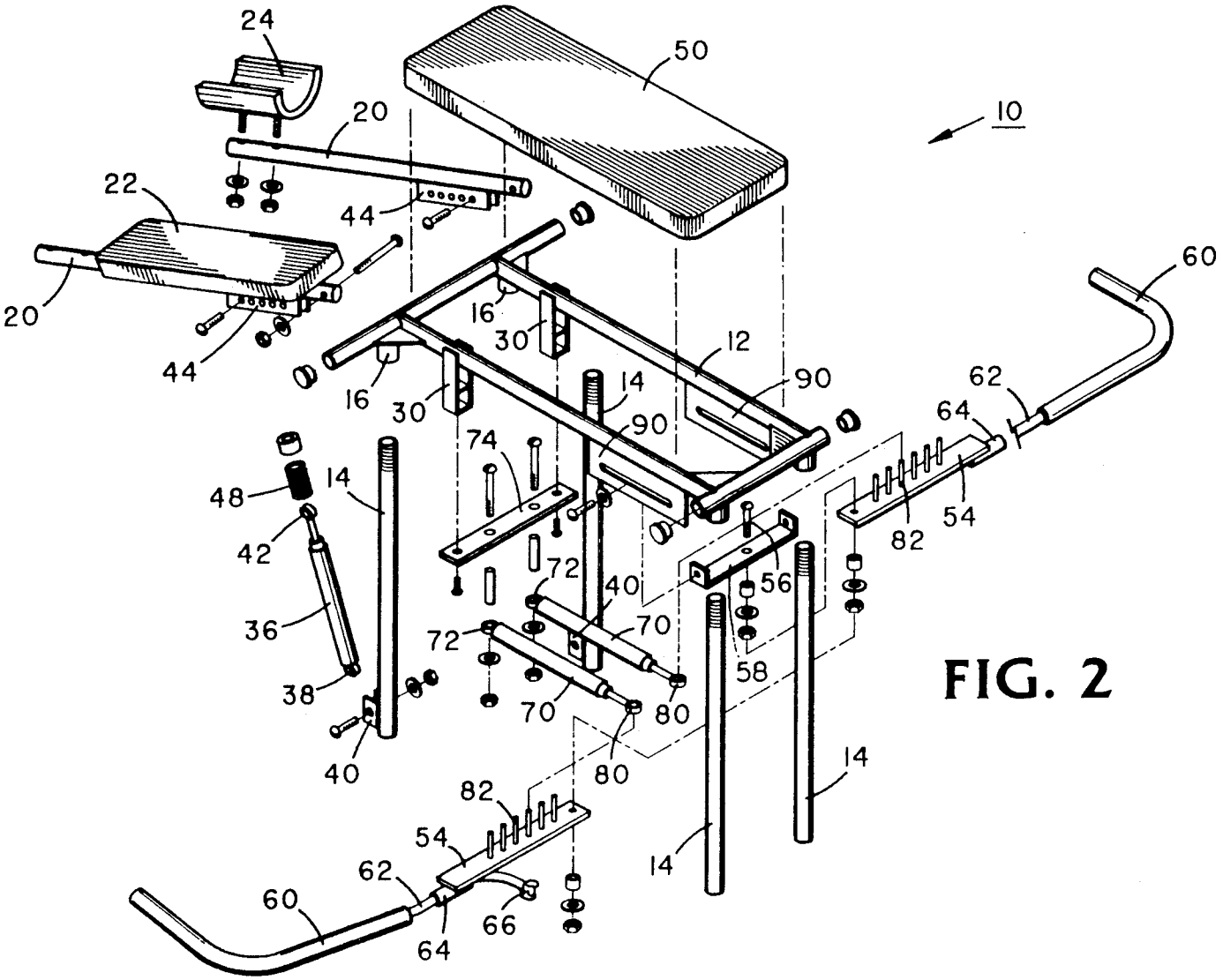
FIG. 2 is an exploded perspective view of the simulator of FIG. 1.

Referring primarily to FIG. 2, the swimming simulator of the present invention, generally indicated by the reference numeral 10, includes a rectilinear horizontal main frame 12 which is supported elevated from a lower surface (not shown) on which the simulator stands by four vertical legs 14 which are attached to the main frame by four half couplings 16 fixedly attached to, and depending from, the main frame.

Extending rearwardly of a first end of main frame 12 are two leg supports 20 on top of which are attached thigh/knee pads 22 (only on shown on FIG. 2) and ankle pads 24 (only one shown on FIG. 2). Straps 26 and 28 (FIG. 1) are provided, respectively, to secure the thighs and ankles of a user (not shown) to pads 22 and 24.

The proximal ends of leg supports 20 are pivotably attached to main frame 16 at brackets 32 such that the leg supports can be rotated upwardly and downwardly about the brackets. Leg supports 20 are movably held in a generally horizontal position by means of two fluid-filled piston cylinders 36 (only one shown on FIG. 2) having the cylinder ends 38 of which pivotally attached to brackets 40 disposed near the lower ends of rear legs 14. The piston rod ends 42 of cylinders 36 are pivotably attached to flanges 44 fixedly attached to, and depending from, leg supports 20. Flanges 44 have a plurality of holes extending horizontally therealong for the selective attachment thereto of piston rod ends 42. Attachment of piston rod ends 42 to holes near the proximal ends of leg supports 20 will permit the leg supports to be pivoted with relatively little resistance, while attachment of the piston rod ends to holes closer to the distal ends of the leg supports will permit the leg supports to be pivoted with relatively great resistance. Two springs 48 (only one shown on FIG. 2) are provided between piston rod ends 42 and the bodies of cylinders 36 to provide additional resistance to downward force.

A torso pad 50 is disposed on the top of main frame 16 to support the torso of a user (not shown).

To provide arm motion resistance, swimming simulator 10 includes two outwardly extending, horizontally rotating members 52 pivotably attached at their proximal ends to a pivot shaft 56 on a horizontal cross bar 58. Hand grips 60 are attached to the distal ends of rotating members 52 by means of flexible cords 62 fixed to and extending from the proximal ends of the hand grips and through tubes 64 fixedly attached to the distal ends of the rotating members. Cords 62 are prevented from pulling out of tubes 64 by means of locking fasteners 66 (only one shown on FIG. 2). Two fluid-filled resistance cylinders 70 are horizontally rotatably attached at their cylinder ends 72 to a horizontal cross bar 74 attached to the lower ends of brackets 30. The piston rod ends 80 of cylinders 70 are pivotably attached to rotating members 52 by means of slipping the ends over selected vertical pegs 82 extending in a row along the top of the rotating members. Placement of piston rod ends 80 over pegs 82 close to the proximal ends of rotating members 52 will permit rotation of the rotating members with relatively little resistance, while placement of the piston rod ends over pegs close to the distal ends of the rotating members will permit rotation of the rotating members with relatively great resistance.

The combination of flexible cords 62, which permit hand grips 60 to be moved in any orientation, and resistance cylinders 70 rotatable in a horizontal plane affords resistance in the pulling and return portions of simulated crawl, back, and butterfly strokes.

Cross bar 58 is adjustably attached to horizontal slots defined in flanges 90 depending from main frame 16 near the front end thereof, to accommodate both short and tall users.

In use, a user (not shown) lies on torso support pad 50 with his chest thereon, for example. To simulate a crawl stroke, the user grasps the distal ends of hand grips 60 and moves the hand grips in a circular or elliptical motion in a generally vertical plane, as indicated by arrow "A" on FIG. 1. With the user's legs strapped to leg supports 20, the user can simulate a flutter kick by moving his legs up and down, as indicated by the arrow "B" on FIG. 1. The degree of resistance to either motion can simulated by the adjustments described above with reference to FIG. 2.

All patent applications, patents, and other documents cited herein are incorporated in their entirety by reference hereinto.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A swimming simulator, comprising:

(a) a horizontal frame having front and rear edges with sides extending therebetween, to support a user in a horizontal plane above a surface on which the simulator is disposed, with said user's shoulders near said front edge of said frame and said user's hips near said rear edge of said frame;

(b) support means to support said frame spaced above said surface;

(c) two generally horizontal bars, having proximal and distal ends, extending outwardly from said sides of said frame, said proximal ends of said bars being rotatably attached at attachment points to said frame such that said distal ends of said horizontal bars can move arcuately in generally horizontal planes;

(d) first resistance means disposed at selected points between said proximal and said distal ends of said horizontal bars to resist said arcuate movement;

(e) hand grips attached to said distal ends of said horizontal bars by means of flexible cords, said hand grips being graspable by said user to move said horizontal bars in said arcuate movement.

2. A swimming simulator, as defined in claim 1, wherein said resistance means comprises two fluid-filled piston cylinders.

3. A swimming simulator, as defined in claim 1, wherein said attachment points are adjustable between said proximal and distal ends.

4. A swimming simulator, as defined in claim 1, further comprising:

(f) two leg supports, having proximal and distal ends, extending rearwardly from said rear edge of said frame, the proximal ends of said leg supports being rotatably attached to said frame such that the distal ends of said leg supports can move arcuately in generally vertical planes;

(g) second resistance means disposed between said leg supports and said frame support means to resist said arcuate movement of said leg supports;

(h) means to releasably attach the legs of said user to said leg supports.

5. A swimming simulator, as defined in claim 4, wherein said second resistance means comprises two fluid-filled piston cylinders.

6. A swimming simulator, as defined in claim 5, further comprising two coil springs disposed between the cylinders of said piston cylinders and said leg supports such that said coil springs will be compressed as said distal ends of said legs supports are rotated downwardly.

7. A swimming simulator, comprising:

(a) a horizontal frame, having front and rear edges, to support a user in a horizontal plane above a surface on which the simulator is disposed, with said user's shoulders near said front edge of said frame and said user's hips near said rear edge of said frame;

(b) supports means to support said frame spaced above said surface;

(c) two legs supports, having proximal and distal ends, extending rearwardly from said rear edge of said frame, the proximal ends of said leg supports being rotatably attached to said frame such that the distal ends of said leg supports can move arcuately in generally vertical planes;

(d) resistance means, comprising two fluid-filled cylinders, disposed between said leg supports and said frame support means to resist said arcuate movement of said leg supports;

(e) means to releasably attach the legs of said user to said leg support; and (f) two coil springs disposed between the cylinders of said piston cylinders and said leg supports such that said coil springs will be compressed as said distal ends of said leg supports are rotated downwardly.

8. A swimming simulator, comprising:

(a) a horizontal frame, having front and rear edges with sides extending therebetween, to support a user in a horizontal plane above a surface on which the simulator is disposed, with said user's shoulders near said front edge of said frame and said user's hips near said rear edge of said frame;

(b) support means to support said frame spaced above said surface;

(c) two generally horizontal bars, having proximal and distal ends, extending outwardly from said sides of said frame, said proximal ends of said bars being rotatably attached at attachment points to said frame such that said distal ends of said horizontal bars can move arcuately in generally horizontal planes;

(d) first resistance means comprising two fluid-filled cylinders disposed at selected points between said proximal and said distal ends of said horizontal bars to resist said arcuate movement;

(e) hand grips attached to said distal ends of said horizontal bars, said hand grips being graspable by said user to move said horizontal bars in said arcuate movement.

9. A swimming simulator, as defined in claim 8, wherein said hand grips are attached to said distal ends by flexible means to permit said hand grips to be moved in any orientation relative to said distal ends.

10. A swimming simulator, as defined in claim 8, wherein said attachment points are adjustable between said proximal and distal ends.

11. A swimming simulator, as defined in claim 8, further comprising:

(f) two leg supports, having proximal and distal ends, extending rearwardly from said rear edge of said frame, the proximal ends of said leg supports being rotatably attached to said frame such that the distal ends of said leg supports can move arcuately in generally vertical planes;

(g) second resistance means disposed between said leg supports and said frame support means to resist said arcuate movement of said leg supports;

(h) means to releasably attach the legs of said user to said leg supports.

12. A swimming simulator, as defined in claim 11, wherein said second resistance means comprises two fluid-filled piston cylinders.

13. A swimming simulator, as defined in claim 12, further comprising two coil springs disposed between the cylinders of said piston cylinders and said leg supports such that said coil springs will be compressed as said distal ends of said leg supports are rotated downwardly.

* * * * *